US006520164B1

(12) United States Patent
Lepp et al.

(10) Patent No.: US 6,520,164 B1
(45) Date of Patent: Feb. 18, 2003

(54) CRANKCASE VENTILATION OIL DRAIN TUBE

(75) Inventors: Noel R. Lepp, Peoria, IL (US); Maurice E. Moushon, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/912,126

(22) Filed: Jul. 24, 2001

(51) Int. Cl.[7] ..... F02B 25/06
(52) U.S. Cl. ..... 123/572
(58) Field of Search ..... 123/572, 573, 123/574, 41.86

(56) References Cited

U.S. PATENT DOCUMENTS

| | | | | |
|---|---|---|---|---|
| 1,862,155 A | | 6/1932 | Mahana et al. | |
| 2,763,247 A | | 9/1956 | Bailey | |
| 2,786,457 A | | 3/1957 | Mickley | |
| 2,849,994 A | | 9/1958 | Barker | |
| 4,453,525 A | | 6/1984 | DeBruler | |
| 4,502,424 A | | 3/1985 | Katoh et al. | |
| 4,674,457 A | | 6/1987 | Berger et al. | |
| 4,996,956 A | | 3/1991 | Hupfer et al. | |
| 5,022,376 A | | 6/1991 | Hudson, Jr. et al. | |
| 5,450,835 A | * | 9/1995 | Wagner | 123/573 |
| 5,579,744 A | * | 12/1996 | Trefz | 123/573 |
| 5,803,025 A | | 9/1998 | Feucht | |
| 5,852,992 A | | 12/1998 | Boggs et al. | |
| 6,024,058 A | | 2/2000 | Burnett | |
| 6,279,555 B1 | * | 8/2001 | Crowell et al. | 123/572 |

* cited by examiner

*Primary Examiner*—Marguerite McMahon
(74) *Attorney, Agent, or Firm*—Marshall, O'Toole, Gerstein, Murray & Borun

(57) ABSTRACT

An oil drain tube is provided for an internal combustion engine, which prevents oil draining from an oil separator from encountering blowby gases. The oil drain tube includes a first non-horizontal tube portion in direct fluid communication with the oil separator, a second non-horizontal tube portion in direct fluid communication with an oil sump and a tube portion connecting the first non-horizontal tube portion and the second non-horizontal tube portion in fluid communication with one another.

15 Claims, 3 Drawing Sheets

CRANKCASE VENTILATION OIL DRAIN TUBE

TECHNICAL FIELD

The present invention relates generally to crankcase ventilation systems for internal combustion engines and, more particularly, to oil drain tubes for returning condensed engine oil from an oil separator of a crankcase ventilation system to an oil sump.

BACKGROUND ART

Oil breather elements or oil separators have been used in internal combustion engines in order to condense and recover oil vapor circulating through crankcase ventilation systems. While it is desirable for the oil to be returned to the engine oil sump, such return of oil can also be affected by foaming due to interaction with "blowby" gases and exposure to undesirable contaminants entrained in blowby gases.

U.S. Pat. No. 5,852,992, issued to Boggs et al. on Dec. 29, 1998, discloses an internal combustion engine having a crankcase ventilation system that includes separate oil drainback and crankcase ventilation passages. In order to prevent blowby gases from flowing past draining oil, the oil drain back passages are configured to extend from the cylinder head to a position below the top level of oil in the crankcase of the engine.

Such a configuration may not be feasible in some engine applications. For example, in some engines, the top level of oil in the engine is below the engine block (e.g., where the nominal oil level has a top level below the top of the oil pan), and some engine blocks have crankcase ventilation passages that extend only down to a position above the top level of oil in the engine crankcase.

The present invention is directed to overcoming one or more of the problems or disadvantages associated with the prior art.

DISCLOSURE OF THE INVENTION

In accordance with one aspect of the present invention, an oil drain tube for an internal combustion engine is provided. The oil drain tube comprises a first non-horizontal tube portion in direct fluid communication with an oil separator, a second non-horizontal tube portion in direct fluid communication with an oil sump and a third tube portion connecting the first non-horizontal tube portion and the second non-horizontal tube portion in fluid communication with one another.

In accordance with another aspect of the present invention, a positive crankcase ventilation system is provided for an internal combustion engine having an engine block and an oil separator. The positive crankcase ventilation system includes an oil drain passage in the engine block wherein the drain passage is disposed in fluid communication with the oil separator, and an oil drain tube. The oil drain tube has a first non-horizontal tube portion in direct fluid communication with the oil separator, a second non-horizontal tube portion in direct fluid communication with an oil sump and a third tube portion connecting the first non-horizontal tube portion and the second non-horizontal tube portion in fluid communication with one another.

In accordance with a still further aspect of the present invention, an internal combustion engine includes an oil sump, an oil separator, an oil drain passage in fluid communication with the oil separator and an oil drain tube. The oil drain tube has a first non-horizontal tube portion in direct fluid communication with the oil separator, a second non-horizontal tube portion in direct fluid communication with the oil sump and a third tube portion connecting the first non-horizontal tube portion and the second non-horizontal tube portion in fluid communication with one another.

Other aspects and features of the present invention can be obtained from a study of the drawings, the disclosure, and the appended claims.

BEST MODE FOR CARRYING OUT THE INVENTION

Figure 1:
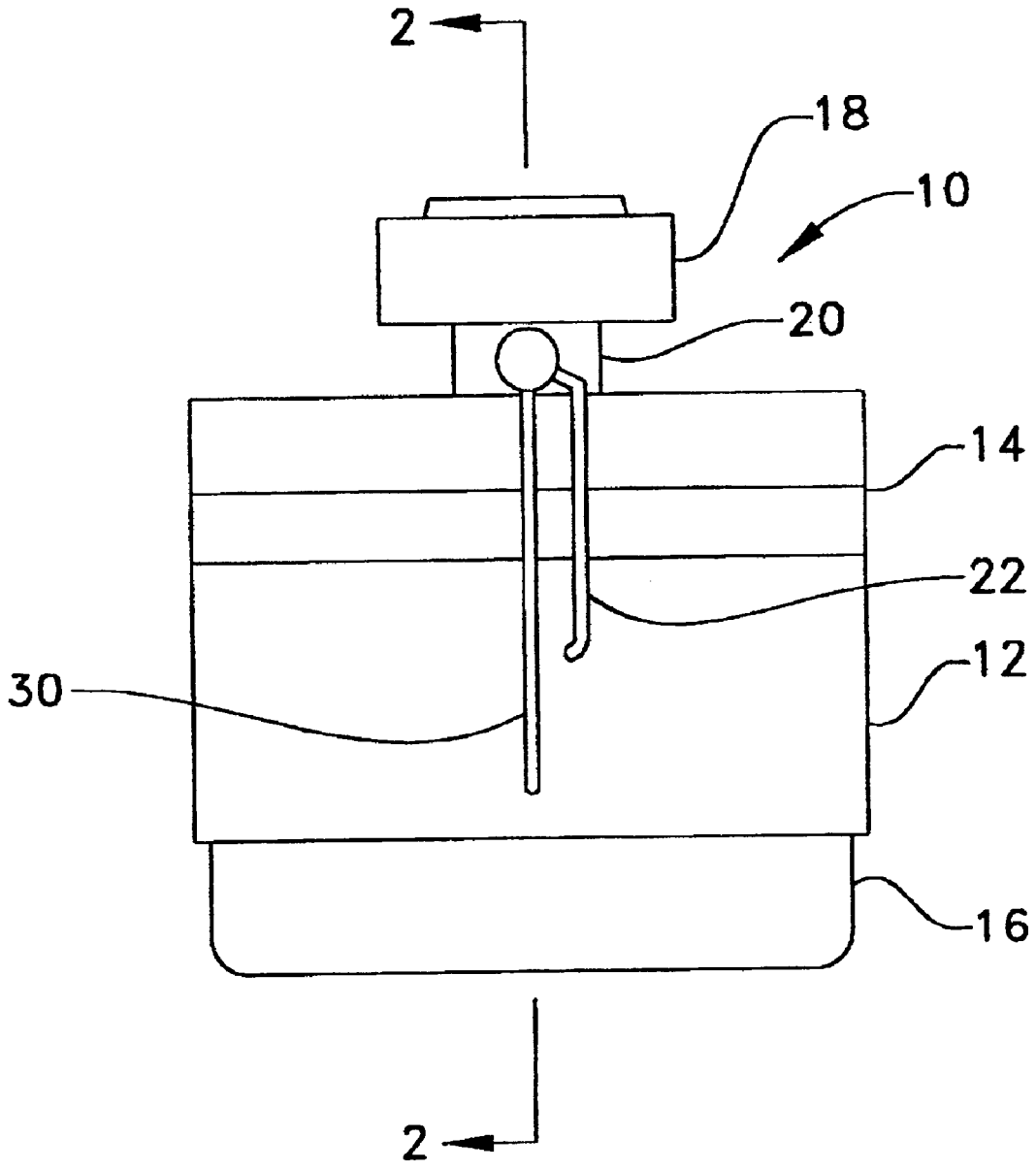
FIG. 1 is a diagrammatic side elevational view of an internal combustion engine having an oil drain tube in accordance with the invention.

With reference initially to FIG. 1, an internal combustion engine, generally indicated at 10, includes an engine block 12, a cylinder head portion 14 attached to the engine block 12 with bolts (not shown) and an oil pan (sump) 16, also attached to the engine block 12 with bolts (not shown). The engine also includes an air cleaner assembly 18 in fluid communication with the cylinder head 14 via an intake passage 20.

In order to prevent undue pressure from building up in the engine block 12, for example, due to "blowby" gases (not shown), a crankcase ventilation line 22 is provided. The ventilation line 22 is connected in fluid communication between an internal engine block ventilation passage 24 (FIG. 2) and an oil separator assembly 26. The passage 24 is in fluid communication with the interior of the engine block 12 and the oil separator assembly 26 is in fluid communication with the intake passage 20 via a blowby gas return line 28. The oil separator assembly 26 may include a breather element (not shown) or alternatively a more elaborate device, such as, for example, a centrifugal oil separator (not shown).

Figure 2:
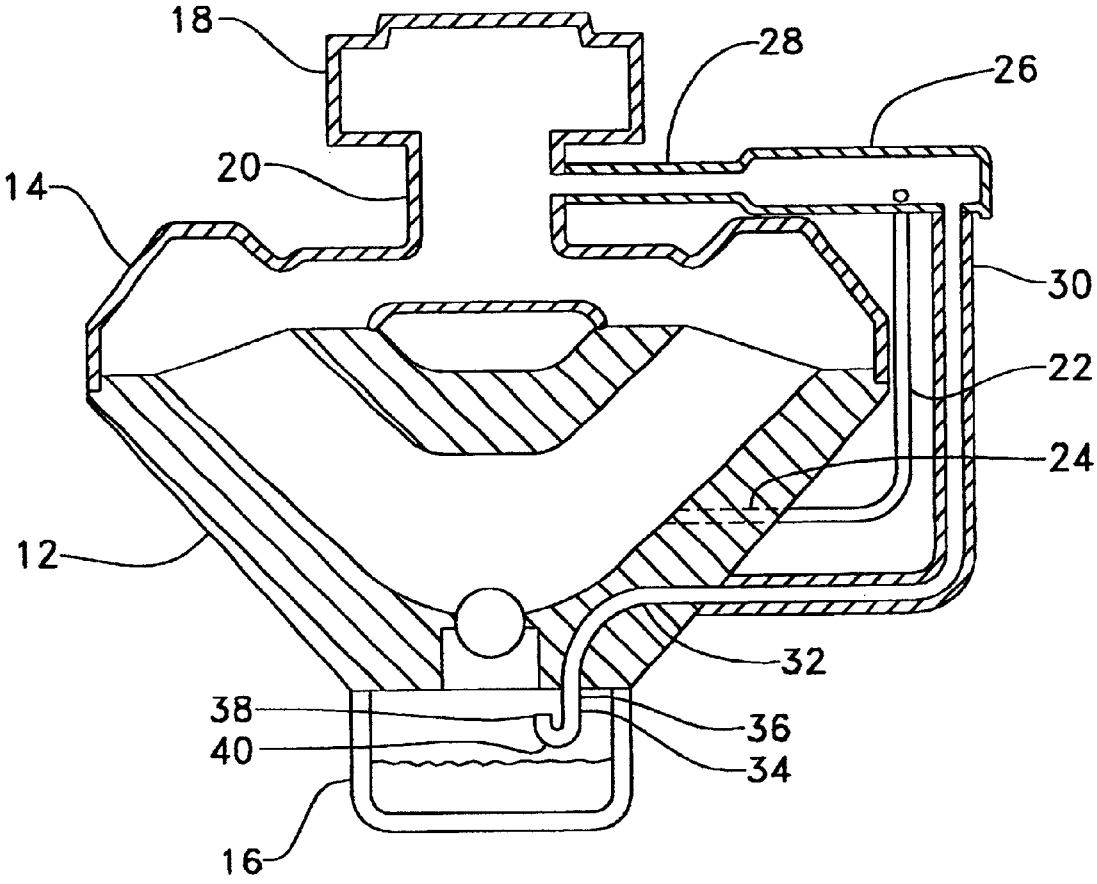
FIG. 2 is a cross-sectional view of the engine of FIG. 1, taken along lines 2—2 of FIG. 1.

With reference to FIG. 2, oil vapor (not shown) entrained in the blowby gases (not shown) are condensed to liquid form in the oil separator assembly 26, and returned to the oil pan (sump) 16 via a drain line 30 that leads to an internal oil drain passage 32 in the engine block 12. In order to prevent blowby gases from entering the oil drain passage 32, a j-shaped oil drain tube 34 is inserted a small distance into the lower end of the oil drain passage 32. The oil drain tube 34 includes a first non-horizontal tube portion 36 in direct fluid communication with the oil separator assembly 26, a second non-horizontal tube portion 38 in direct fluid communication with the oil pan (sump) 16 and a generally horizontal tube portion 40 connecting the first non-horizontal tube portion 36 and the second non-horizontal tube portion 38 in fluid communication with one another.

Industrial Applicability

As oil condenses to liquid form in the oil separator assembly 26 and drains through passages 30 and 32 into the oil pan (sump) 16, a small quantity of oil is trapped in the bottom portion of the j-shaped oil drain tube 34, thereby sealing off the tube portion 36 from the tube portion 38. In this regard, the tube portion 38 has sufficient height to permit accumulation of oil to a level above a lowermost point or portion of an inner wall of the tube portion 40. This small quantity of oil prevents blowby gases from returning to the sump 16 via passages 30 and 32. Accordingly, degradation and contamination of oil due to repeated exposure to blowby gases is dramatically reduced.

Figure 3:
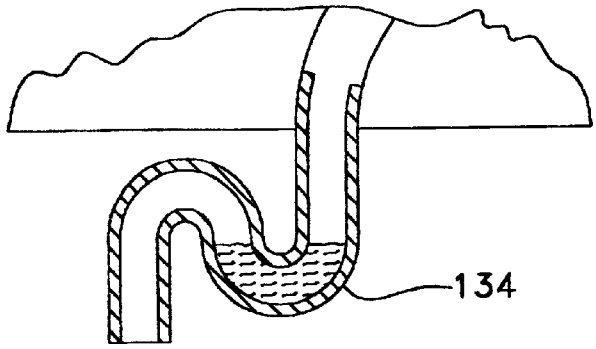
FIG. 3 is a cross-sectional view of an alternative oil drain tube in accordance with the invention.

FIG. 3 depicts an alternative oil drain tube 134, having a substantially S-shaped geometry.

Figure 4:
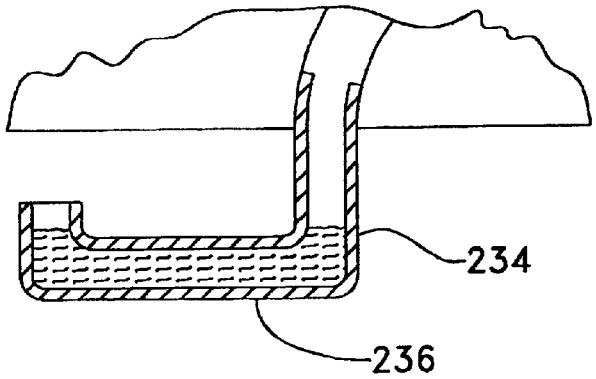
FIG. 4 is a cross-sectional view of a second alternative oil drain tube in accordance with the invention.

FIG. 4 depicts a second alternative j-shaped oil drain tube 234, having an elongate horizontal tube portion 236.

Figure 5:
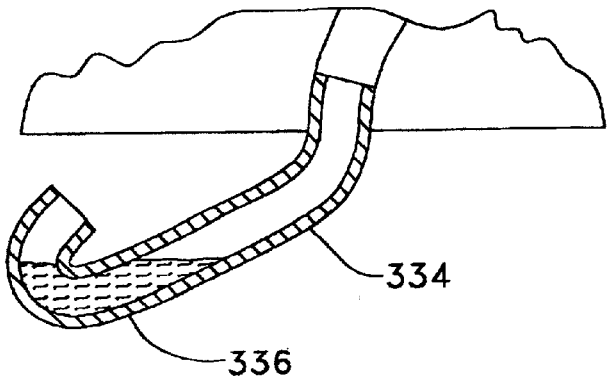
FIG. 5 is a cross-sectional view of a third alternative oil drain tube in accordance with the invention.

FIG. 5 depicts a third alternative oil drain tube 334, having a substantially hook-shaped geometry and an inclined tube portion 336.

Numerous modifications and alternative embodiments of the invention will be apparent to those skilled in the art in view of the foregoing description. For example, any suitable shape for the oil drain tube may be employed, such as, for example, a u-shape or v-shape instead of the j-shapes, hook shape or S-shape as shown and described herein. In addition, the oil drain tube could be integral with an oil drain passage in the engine block, instead of being a separate piece. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed is:

1. An oil drain tube for an internal combustion engine having an engine block, an oil sump, an oil separator, and an oil drain passage in the engine block, wherein the oil drain passage is in fluid communication with the oil separator, comprising:

a first non-horizontal tube portion in direct fluid communication with the oil separator;

a second non-horizontal tube portion in direct fluid communication with the oil sump; and a third tube portion connecting the first non-horizontal tube portion and the second non-horizontal tube portion in fluid communication with one another;

wherein the second non-horizontal tube portion terminates in a tube end above the level of oil in the oil sump.

2. An oil drain tube for an internal combustion engine having an engine block, an oil sump, an oil separator, and an oil drain passage in the engine block, wherein the oil drain passage is in fluid communication with the oil separator, comprising:

a first non-horizontal tube portion in direct fluid communication with the oil separator;

a second non-horizontal tube portion in direct fluid communication with the oil sump; and a third tube portion connecting the first non-horizontal tube portion and the second non-horizontal tube portion in fluid communication with one another wherein the first non-horizontal tube portion includes a portion of the oil drain passage in the engine block.

3. The oil drain tube of claim 1, wherein the oil drain tube is adapted to be inserted into the oil drain passage in the engine block.

4. An oil drain tube for an internal combustion engine having an engine block, an oil sump, an oil separator, and an oil drain passage in the engine block, wherein the oil drain passage is in fluid communication with the oil separator, comprising:

a first non-horizontal tube portion in direct fluid communication with the oil separator;

a second non-horizontal tube portion in direct fluid communication with the oil sump; and a third tube portion connecting the first non-horizontal tube portion and the second non-horizontal tube portion in fluid communication with one another wherein the oil drain tube has a substantially j-shaped geometry.

5. An oil drain tube for an internal combustion engine having an engine block, an oil sump, an oil separator, and an oil drain passage in the engine block, wherein the oil drain passage is in fluid communication with the oil separator, comprising:

a first non-horizontal tube portion in direct fluid communication with the oil separator;

a second non-horizontal tube portion in direct fluid communication with the oil sump; and a third tube portion connecting the first non-horizontal tube portion and the second non-horizontal tube portion in fluid communication with one another wherein the oil drain tube has a substantially S-shaped geometry.

6. A positive crankcase ventilation system for an internal combustion engine having an engine block, an oil sump and an oil separator, the positive crankcase ventilation system comprising:

an oil drain passage in the engine block, in fluid communication with the oil separator;

an oil drain tube including a first non-horizontal tube portion in direct fluid communication with the oil separator, a second non-horizontal tube portion in direct fluid communication with the oil sump and a third tube portion connecting the first non-horizontal tube portion and the second non-horizontal tube portion in fluid communication with one another;

wherein the second non-horizontal tube portion terminates in a tube end above the level of oil in the oil sump.

7. A positive crankcase ventilation system for an internal combustion engine having an engine block, an oil sump and an oil separator, the positive crankcase ventilation system comprising:

an oil drain passage in the engine block, in fluid communication with the oil separator;

an oil drain tube including a first non-horizontal tube portion in direct fluid communication with the oil separator, a second non-horizontal tube portion in direct fluid communication with the oil sump and a third tube portion connecting the first non-horizontal tube portion and the second non-horizontal tube portion in fluid communication with one another wherein the first non-horizontal tube portion includes a portion of the oil drain passage in the engine block.

8. The apparatus of claim 6, wherein the oil drain tube is adapted to be inserted into the oil drain passage in the engine block.

9. A positive crankcase ventilation system for an internal combustion engine having an engine block, an oil sump and an oil separator, the positive crankcase ventilation system comprising:

an oil drain passage in the engine block, in fluid communication with the oil separator;

an oil drain tube including a first non-horizontal tube portion in direct fluid communication with the oil separator, a second non-horizontal tube portion in direct fluid communication with the oil sump and a third tube portion connecting the first non-horizontal tube portion and the second non-horizontal tube portion in fluid communication with one another wherein the oil drain tube has a substantially j-shaped geometry.

10. A positive crankcase ventilation system for an internal combustion engine having an engine block, an oil sump and an oil separator, the positive crankcase ventilation system comprising:

an oil drain passage in the engine block, in fluid communication with the oil separator;

an oil drain tube including a first non-horizontal tube portion in direct fluid communication with the oil separator, a second non-horizontal tube portion in direct fluid communication with the oil sump and a third tube portion connecting the first non-horizontal tube portion and the second non-horizontal tube portion in fluid communication with one another wherein the oil drain tube has a substantially S-shaped geometry.

11. An internal combustion engine, comprising:

an oil sump;

an oil separator;

an oil drain passage in fluid communication with the oil separator;

an oil drain tube, the oil drain tube including a first non-horizontal tube portion in direct fluid communication with the oil drain passage, a second non-horizontal tube portion in direct fluid communication with the oil sump and a third tube portion connecting the first non-horizontal tube portion and the second non-horizontal tube portion in fluid communication with one another;

wherein the second non-horizontal tube portion terminates in a tube end above the level of oil in the oil sump.

12. The apparatus of claim 11, wherein the first non-horizontal tube portion includes a portion of the oil drain passage.

13. The apparatus of claim 11, wherein the oil drain tube is adapted to be inserted into the oil drain passage.

14. An internal combustion engine, comprising:

an oil sump;

an oil separator;

an oil drain passage in fluid communication with the oil separator;

an oil drain tube, the oil drain tube including a first non-horizontal tube portion in direct fluid communication with the oil drain passage, a second non-horizontal tube portion in direct fluid communication with the oil sump and a third tube portion connecting the first non-horizontal tube portion and the second non-horizontal tube portion in fluid communication with one another wherein the oil drain tube has a substantially j-shaped geometry.

15. An internal combustion engine, comprising:

an oil sump;

an oil separator;

an oil drain passage in fluid communication with the oil separator;

an oil drain tube, the oil drain tube including a first non-horizontal tube portion in direct fluid communication with the oil drain passage, a second non-horizontal tube portion in direct fluid communication with the oil sump and a third tube portion connecting the first non-horizontal tube portion and the second non-horizontal tube portion in fluid communication with one another wherein the oil drain tube has a substantially S-shaped geometry.

* * * * *